US009434454B2

(12) United States Patent
Wamilton

(10) Patent No.: US 9,434,454 B2
(45) Date of Patent: Sep. 6, 2016

(54) PERSONAL WATERCRAFT HAVING A UNITARY SEAT AND HOOD ASSEMBLY

(71) Applicant: Wamilton's Custom Inc., Riviera Beach, FL (US)

(72) Inventor: Teixeira L. Wamilton, Riviera Beach, FL (US)

(73) Assignee: WAMILTON'S CUSTOM INC., Riviera Beach, FL (US)

( * ) Notice: Subject to any disclaimer, the term of this patent is extended or adjusted under 35 U.S.C. 154(b) by 0 days.

(21) Appl. No.: 14/510,018

(22) Filed: Oct. 8, 2014

(65) Prior Publication Data

US 2016/0101834 A1 Apr. 14, 2016

(51) Int. Cl.

| | |
|---|---|
| ***B63B 35/73*** | (2006.01) |
| *B63B 29/04* | (2006.01) |
| *B63B 19/14* | (2006.01) |

(52) U.S. Cl.

CPC ..... *B63B 35/731* (2013.01); *B63B 19/14* (2013.01); *B63B 2029/043* (2013.01); *B63B 2241/20* (2013.01)

(58) Field of Classification Search

CPC ..... B63B 35/731; B63B 19/14; B63B 2029/043

USPC ..... 114/55.53

See application file for complete search history.

(56) References Cited

U.S. PATENT DOCUMENTS

| | | | | |
|---|---|---|---|---|
| 4,986,208 | A * | 1/1991 | Kobayashi | B63B 35/731 114/144 R |
| 5,449,305 | A * | 9/1995 | Kobayashi | B63B 35/731 114/363 |
| 5,743,206 | A * | 4/1998 | Hattori | B63B 1/08 114/55.51 |

* cited by examiner

*Primary Examiner* — Andrew Polay
(74) *Attorney, Agent, or Firm* — Ferris H. Lander, Inc.

(57) ABSTRACT

A personal watercraft or alternative motorized vehicle including a superstructure characterized by a unitary seat and hood assembly, which incorporates an integral steering mechanism therein. By providing a unitary seat and hood assembly, and integrating the steering mechanism therein, the height of the deck assembly, at which point it is in juxtaposed relationship with the seat and hood assembly can be substantially lower than in prior art devices. This design allows for raising of the unitary hood and seat assembly about a single pivot point, thereby providing an interface of juxtaposition which defines an extended singular engine compartment opening that enables unfettered access to the entire engine compartment. This extended singular engine compartment opening is of sufficient size and breadth to permit removal of the entire engine assembly.

4 Claims, 4 Drawing Sheets

PERSONAL WATERCRAFT HAVING A UNITARY SEAT AND HOOD ASSEMBLY

FIELD OF THE INVENTION

The present invention relates to personal watercraft (otherwise referred to as "PWCs"). More specifically, the present invention relates to a superstructure for a personal watercraft or other motorized vehicle, characterized by a unitary seat and hood assembly, having a steering mechanism integral therewith, which interacts with a deck assembly to overly and seal an engine compartment opening formed in said deck assembly when placed in juxtaposed and releasable engagement therewith.

BACKGROUND OF THE INVENTION

PWCs are a type of recreational vehicle having a hull and a deck with a straddle-type seat disposed on the deck. The seat is typically configured to hold one or more riders.

The seat on a PWC is typically supported by a pedestal portion of a deck assembly, which is generally elevated with respect to a lower portion of the deck upon which the driver (or rider) places his or her feet. A central portion of the deck and pedestal assembly is generally further elevated, in order to accommodate the necessary steering mechanism at a convenient height for the driver. The seat is generally removable from the pedestal portion of the deck. Removal of the seat reveals an opening in the deck that leads to the interior of the PWC. Since the engine is typically located beneath the seat, after the seat has been removed, the engine is accessible through the opening to allow routine maintenance and repairs. Forward of the seat portion and centrally located elevated steering mechanism, is a hood assembly which covers another opening in the deck, providing further access to portions of the engine and other components.

To allow the driver and rider(s) to comfortably straddle the seat in either a seated or a standing position, the pedestal portion of the deck typically narrows from the base portion (where it extends from the deck) to the seat.

The progressive narrowing of the pedestal portion of the deck toward the top, causes the deck opening beneath the seat to become too small for certain types of maintenance to easily be performed on the engine. Furthermore, the permanently mounted steering mechanism positioned in a central portion of the deck, necessitates the provision of two access openings, one fore and one aft of the steering assembly, each providing limited access to the underlying engine compartment. Additionally, if the engine needs to be removed entirely from the PWC, some of the engine components must be partially removed from the engine while it is still in the personal watercraft before it can be removed through the opening in the pedestal. This procedure can be complex, time consuming, and expensive.

A need, therefore, exists for a PWC design that allows a wide variety of different types of routine maintenance to be performed easily on the engine.

There is an additional need for a personal watercraft that allows the engine to be removed from the watercraft as a unit, without requiring substantial removal of the engine components or damage to the PWC.

Attempts to address these needs in the prior art have led to complicated construction requiring partial disassembly of the vessel's superstructure in order to provide reasonable access to the engine and related components.

DESCRIPTION OF THE PRIOR ART

U.S. Published Application 2013/0213419, to Duval et al, published Nov. 20, 2003 is directed toward a personal watercraft having a hull, an engine disposed in the hull, a propulsion unit driven by the engine, and a steering unit to steer the propulsion unit. A deck is supported above the hull. The deck includes an opening there through to provide access to the engine. A pedestal is disposed on the deck, in juxtaposition to the engine access opening, and releasably fastened to the deck. The pedestal includes an opening therethrough. The pedestal opening is disposed at a position vertically above the deck opening. A seat is supported by the pedestal and releasably fastened thereto. The seat is moveable from a first position where the seat covers the pedestal opening to at least a second position where the seat does not cover the pedestal opening. In order to gain access to the engine, the seat must first be removed, and subsequently the pedestal assembly, which is intermediate to the seat and deck, must also be removed in order to gain reasonable access to the engine compartment.

SUMMARY OF THE INVENTION

The present invention differs from the prior art by providing a superstructure for a personal watercraft, or other powered vehicle, characterized by a unitary seat and hood assembly, which incorporates the steering mechanism therein, and enables a configuration whereby simply pivoting the unitary seat and hood assembly upwards from the deck provides unfettered access to the entire engine compartment. More specifically, the present invention relates to a unitary seat and hood assembly, which interacts with a deck assembly to overly, and seal a deck opening formed in said deck assembly when placed in juxtaposed relationship therewith.

By providing a unitary seat and hood assembly, and integrating the steering mechanism therein, the height of the deck/pedestal assembly, at which point it is in juxtaposed relationship with the seat and hood assembly can be substantially lower than in prior art devices. This design allows for raising of the unitary hood and seat assembly about a single pivot point, thereby providing an interface of juxtaposition, which results in unfettered access to the entire engine compartment. The interface defines an extended singular engine compartment opening; as opposed to a pair of smaller openings surrounding the raised steering mechanism of prior art devices. This extended singular engine compartment opening is of sufficient size and breadth to permit unfettered access to the engine compartment and permit removal of the entire engine assembly therethrough without the need for partial disassembly.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
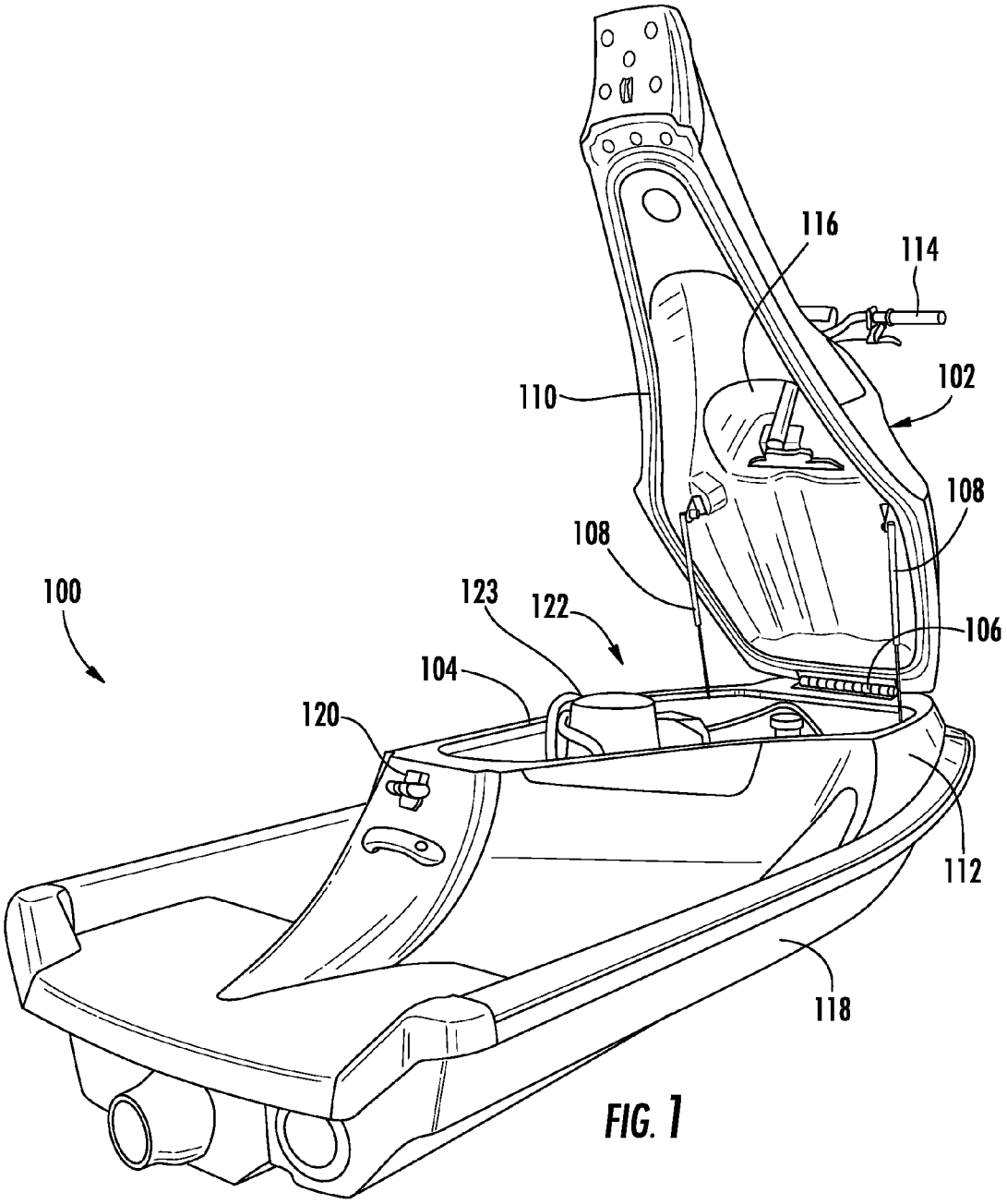
FIG. 1 illustrates a perspective view of a personal watercraft in accordance with the present invention in which the unitary seat and hood assembly is in an open position, thereby providing access to the engine compartment.

Now referring to FIG. 1, this figure illustrates a perspective view of the personal watercraft 100 in accordance with the present invention in which the unitary seat and hood assembly 102 is shown in an open position, thereby providing access to the engine compartment opening 104 and engine compartment 122. Engine compartment 122 contains an engine 123 disposed between the hull assembly 118 and the deck assembly 112; and a propulsion unit (not shown) driven by the engine 123. Unitary hood and seat assembly 102 is shown as being hinged at hinge mechanism 106, and is maintained in a stable and upright position via struts 108. It is understood that the illustrated strut mechanisms 108 and hinge mechanism 102 are merely illustrative and non-limiting, and any means of providing opening, closure, and stabilization of the unitary hood and seat assembly 102, is contemplated by the present invention. A sealing interface 110 is provided at the point of juxtaposition of the unitary hood and seat assembly 102 with the engine compartment opening 104 formed in deck assembly 112. The sealing interface 110 may be in the form of any suitable seal or gasket effective to cushion the interface of components 102 and 112. Integral steering assembly 114 is shown residing in area 116 of unitary hood and seat assembly 102. It is understood that the particular steering mechanism 114 is merely illustrative and non-limiting. Any suitable steering mechanism is contemplated for use by the present invention. Deck assembly 112 is in juxtaposed relationship with underlying hull assembly 118. When it is desired to close the unitary hood and seat assembly 102, said assembly can be locked into its sealed position with deck assembly 112 by use of a locking device, illustrated by, albeit not limited to latch 120.

Figure 2:
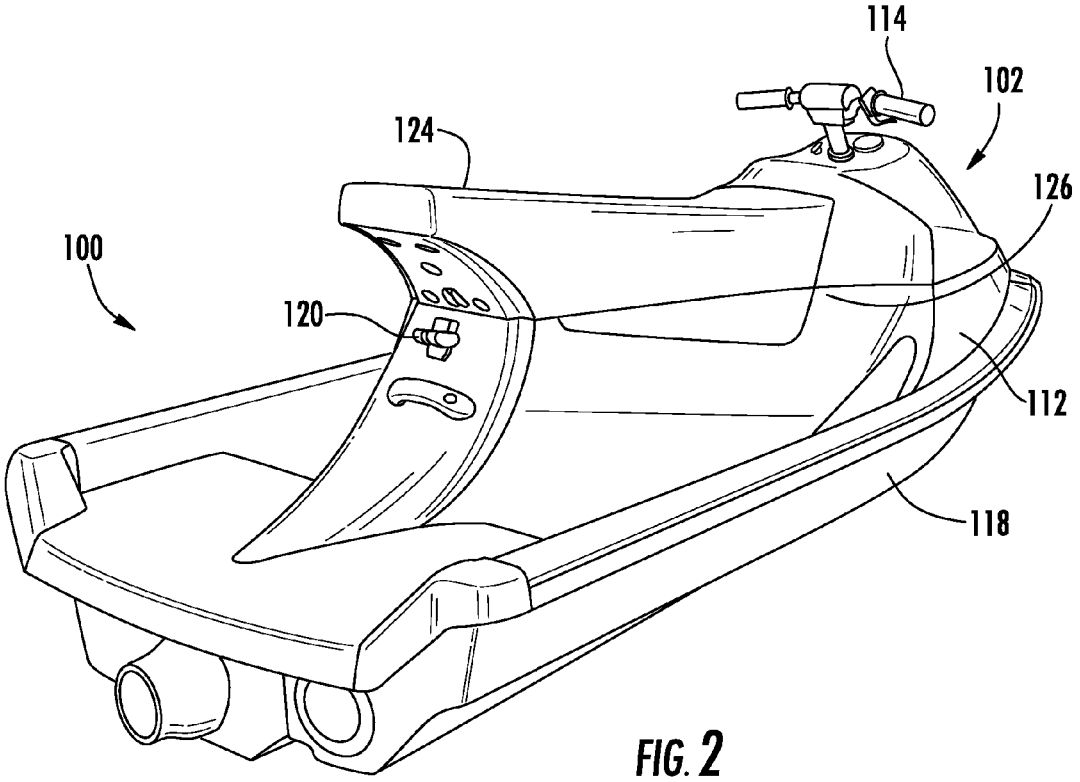
FIG. 2 illustrates a perspective view of a personal watercraft in accordance with the present invention in which the unitary seat and hood assembly is in a closed position, thereby sealing off and protecting the engine compartment.
Figure 3:
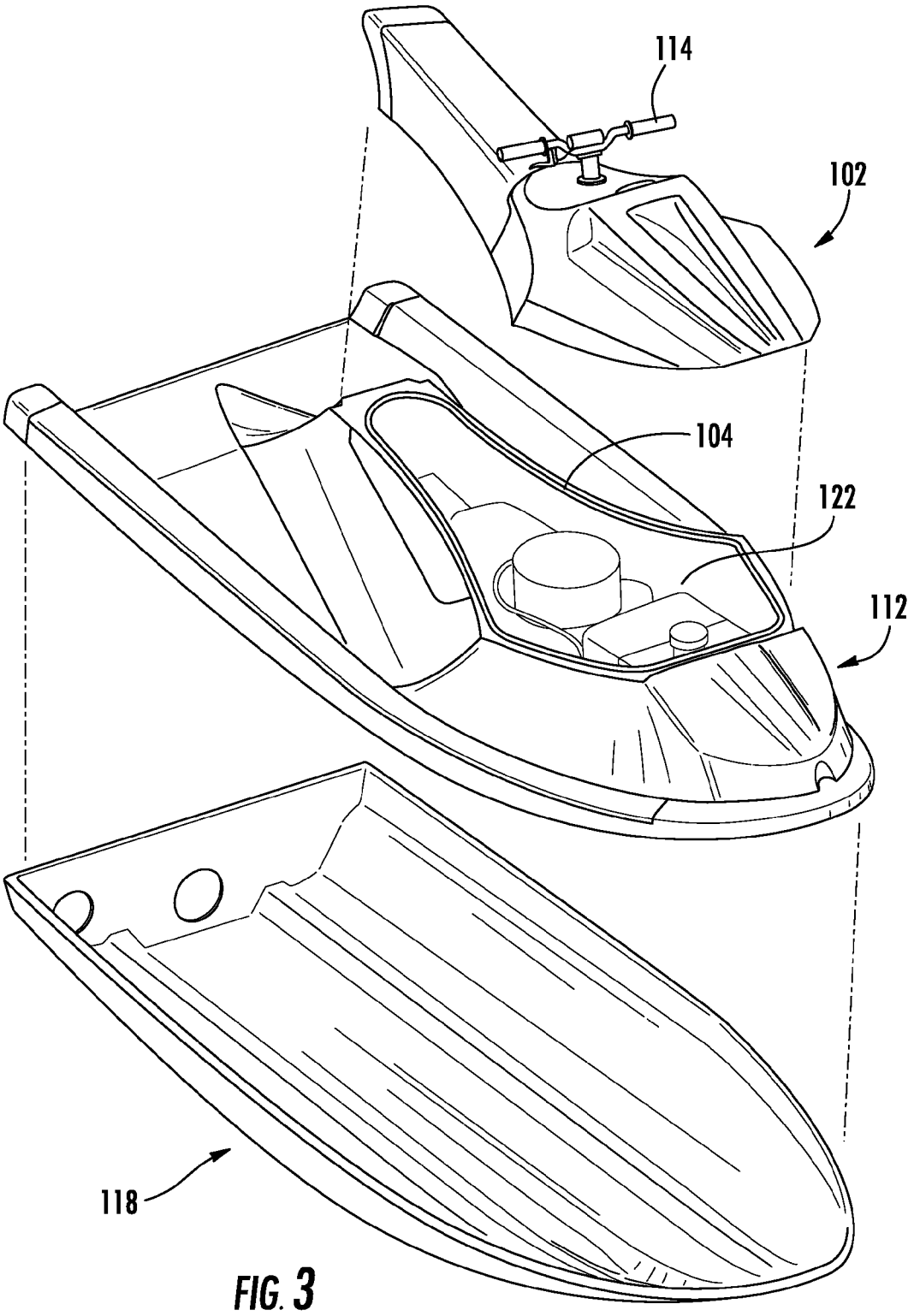
FIG. 3 illustrates an exploded view of the components of the personal watercraft superstructure, thereby illustrating the juxtaposed relationship of the hull assembly, deck assembly and unitary seat and hood assembly.

Now referring to FIG. 2 wherein a perspective view of a personal watercraft 100 is illustrated in accordance with the present invention in which the unitary seat and hood assembly 102 is in a closed position, thereby sealing off and protecting the engine compartment 122 (FIG. 1). In this illustration, seat 124 is more easily visualized. It is apparent that unitary hood and seat assembly 102, inclusive of steering mechanism 114 is constructed and arranged to provide seat 125 at an appropriate height above the lowermost portion of deck assembly 112 while maintaining an ergonomically appropriate relationship between seat 114 and steering mechanism 114. This particular mode of construction results in an interface of juxtaposition 126 which is sufficiently low to enable formation of a relatively large engine compartment opening With reference to FIG. 3 an exploded view of the components 102, 112 and 118 of the personal watercraft superstructure is shown. This view illustrates the juxtaposed relationship of the hull assembly 118, deck assembly 112 and unitary seat and hood assembly 102. Although the invention has been exemplified with regard to personal watercraft, alternative embodiments are within the purview of the invention utilizing the novel subcombination of a unitary seat and hood assembly, having a steering mechanism integral therewith, which interacts with an underlying frame or body to overly and seal an engine compartment opening formed in said underlying frame or body when placed in juxtaposed and releasable engagement therewith. Therefore, it is within the purview of the present invention to combine such a unitary seat and hood assembly, as herein described, any powered vehicle, illustrated by, albeit not limited to a snowmobile, go-kart, golf-kart or the like.

Figure 4:
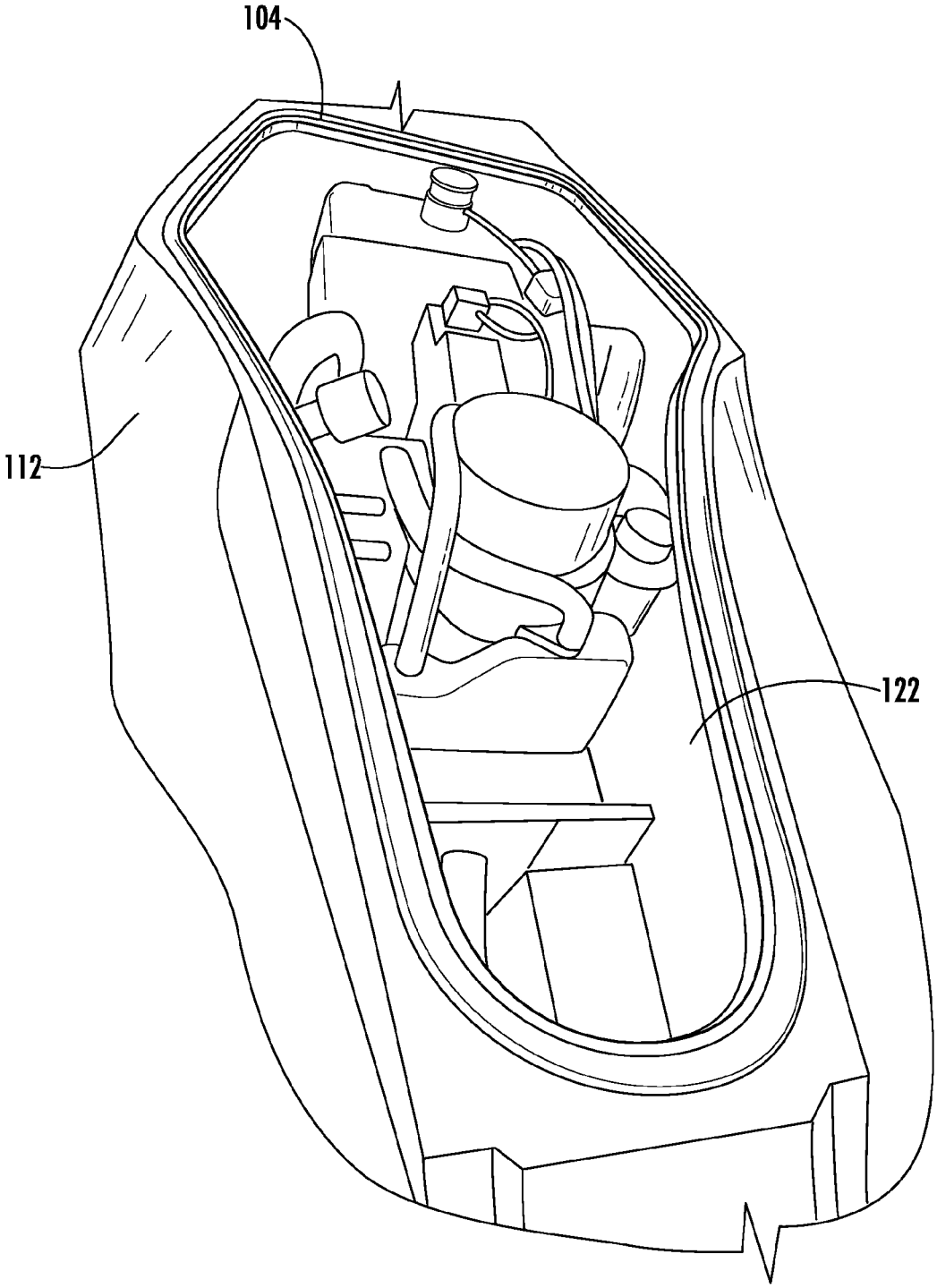
FIG. 4 is an isolated perspective view of the deck assembly, with the unitary seat and hood assembly removed, illustrating the degree of access provided by the present configuration to the engine compartment.

Referring to FIG. 4, an isolated perspective view of the deck assembly 112, with the unitary seat and hood assembly 102 removed to aid visualization, illustrating the highly improved and unfettered access to the engine compartment 122 via the engine compartment opening 104 as a result of the formation of the unitary hood and seat assembly 102 (FIG. 1) provided in the instantly configured personal watercraft 100.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention, which are obvious to those skilled in the art, are intended to be within the scope of the following claims.

What is claimed is:

1. A personal watercraft comprising: a hull assembly; a deck assembly in juxtaposed relationship with said hull assembly; an engine compartment disposed between the hull assembly and the deck assembly; a propulsion unit driven by the engine; the deck assembly including an extended singular engine compartment opening therethrough to provide access to the engine; a unitary seat and hood assembly containing an integrated steering assembly, said unitary seat and hood assembly constructed and arranged to be raised from said deck assembly about a single pivot point, thereby providing an interface of juxtaposition which defines said extended singular engine compartment opening and which is of a size and breadth that permits insertion or removal of an entire engine therethrough without need for partial disassembly of said engine, said unitary seat and hood assembly being in juxtaposed relationship with the deck assembly and releasably attached to said deck assembly; said unitary seat and hood assembly being moveable from a first position where said unitary assembly is in sealing engagement with said extended singular engine compartment opening to at least a second position where said unitary seat and hood assembly permits access to said engine compartment opening.

2. The watercraft of claim 1, further comprising a sealing interface disposed at said interface of juxtaposition between the deck assembly and the unitary seat and hood assembly.

3. The watercraft of claim 1, further comprising a lock for locking the deck assembly and the unitary seat and hood assembly in a sealed position.

4. The watercraft of claim 1, wherein said single pivot point about which said unitary seat and hood assembly are hingedly connected to said deck is a hinge.

* * * * *